US012006708B1

(12) United States Patent
Koerner

(10) Patent No.: US 12,006,708 B1
(45) Date of Patent: Jun. 11, 2024

(54) CONCRETE CONTAINER

(71) Applicant: Robert H. Koerner, Coal City, IL (US)

(72) Inventor: Robert H. Koerner, Coal City, IL (US)

( * ) Notice: Subject to any disclaimer, the term of this patent is extended or adjusted under 35 U.S.C. 154(b) by 0 days.

(21) Appl. No.: 18/482,932

(22) Filed: Oct. 9, 2023

Related U.S. Application Data

(60) Provisional application No. 63/420,120, filed on Oct. 28, 2022.

(51) Int. Cl.
*E04G 21/02* (2006.01)
*E04G 21/04* (2006.01)

(52) U.S. Cl.
CPC ..... *E04G 21/025* (2013.01); *E04G 21/0427* (2013.01); *E04G 21/0472* (2013.01)

(58) Field of Classification Search
CPC ..... E04G 21/025; E04G 21/0427; E04G 21/0472
See application file for complete search history.

(56) References Cited

U.S. PATENT DOCUMENTS

2006/0054645 A1* 3/2006 Lang ..... E04G 21/025 222/529
2008/0134623 A1* 6/2008 Johnson ..... E04G 21/04 52/742.14
2010/0050567 A1* 3/2010 Vandewinckel ..... E04G 21/025 52/749.13
2018/0200920 A1* 7/2018 Zhang ..... B28C 7/161
2019/0308342 A1* 10/2019 Butler ..... C04B 40/0028
2020/0149269 A1* 5/2020 Crump ..... D04B 1/00
2020/0199862 A1* 6/2020 Le Roux ..... E04G 21/0427
2023/0120412 A1* 4/2023 Strong ..... B28C 9/0463 137/351
2023/0366222 A1* 11/2023 Pettit ..... E04G 21/0427

* cited by examiner

*Primary Examiner* — Saul Rodriguez
*Assistant Examiner* — Ashley K Romano
(74) *Attorney, Agent, or Firm* — Philip L. Bateman

(57) ABSTRACT

A concrete container has a barrel having an open top, a closed bottom, and a discharge conduit near the closed bottom extending away from the barrel, a hose connected to the discharge conduit, and a valve attached to the discharge conduit.

6 Claims, 3 Drawing Sheets

CONCRETE CONTAINER

CROSS-REFERENCE TO RELATED APPLICATION

This application claims the benefit of U.S. Provisional Patent Application Ser. No. 63/420,120, Oct. 28, 2022.

FIELD OF THE INVENTION

This invention relates to setting construction materials.

BACKGROUND OF THE INVENTION

1. Concrete

Concrete is a construction material that is the most widely used man-made material in the world. Concrete is a fluid material when first made and solidifies (sets up) over time. Small amounts of concrete solidify in less than an hour. Larger amounts of concrete solidify in several hours and do not reach maximum strength for days or even weeks. There are many reasons for the popularity of concrete. It is relatively inexpensive, capable of taking on the shape of a mold, exceptionally high in compression strength, and very durable.

Concrete is composed of cement, aggregate (sand, gravel, crushed stone, etc.), and water. Cement is a fine gray powder typically consisting of calcium oxide CaO (commonly known as lime), silicon dioxide $SiO_2$ (commonly known as silica), aluminum oxide $Al_2O_3$ (commonly known as alumina), iron oxide, and other materials. Cement reacts with the water to form chemical bonds that hold the materials together in concrete. Cement is commonly made by heating limestone (which primarily contains calcium carbonate $CaCO_3$) and then grinding. Naturally occurring limestone sometimes contains the desired amounts of silicon dioxide, aluminum oxide, and iron oxide. If not, clays and/or other materials are added to obtain the desired composition.

A wide variety of materials are sometimes added to cement to improve the properties of the concrete made with the cement. Such materials include fly ash, slag, silica fume, metakaolin, cellulose derivatives, and a variety of proprietary chemicals.

2. Preparation and Delivery of Concrete

Concrete is prepared by mixing the dry ingredients (cement and aggregate) with water. Concrete is very heavy. One cubic foot ($ft^3$) of wet concrete weighs about 150 pounds. Unless otherwise indicated expressly or by context, the term "about" is used herein to mean plus or minus 25 percent of the measurement or other quantified property referenced. One cubic yard ($yd^3$) weighs about 4000 pounds.

When relatively small amounts of concrete are needed, it is typically made by pouring the dry ingredients from bags into a wheelbarrow or other container, adding water, and then mixing with a shovel or hoe. Portable powered mixers are also used. One 40 pound bag of dry concrete mix yields about 0.3 cubic feet of wet concrete after the addition of about five pounds of water. Handling and dumping bags, and manual mixing becomes prohibitively slow and labor intensive as the amount of concrete needed exceeds about two cubic feet. Johnson, U.S. Pat. Appln. Publn. No. 2008/0134623, Jun. 12, 2008, discloses a method for mixing a cementitious material at a construction site.

Relatively large amounts of concrete are typically prepared at concrete plants and then delivered to the construction site in concrete trucks having a rotating drum. It is not economical to prepare and deliver amounts of concrete less than about twenty cubic feet. Delivering concrete from a single truck to multiple construction sites can reduce the amounts somewhat, but requires simultaneous multiple demands for the smaller amounts.

From the above, it can be appreciated that there currently is no efficient and economical way of preparing and delivering medium amounts (about two to twenty cubic feet weighing about 300 to 3000 pounds) of concrete to construction sites. Accordingly, there is a demand for an improved container for concrete. There is also a demand for an improved method for delivering a medium amount of concrete to a construction site.

SUMMARY OF THE INVENTION

One general object of this invention is to provide an improved container for concrete. Another general object of this invention is to provide an improved method for delivering a medium amount of concrete to a construction site.

I have invented an improved concrete container. The container comprises: (a) a barrel having an open top, a closed bottom, an interior adapted for holding an amount of concrete, and a discharge conduit near the closed bottom extending away from the barrel; (b) a hose connected to the discharge conduit, the hose having a distal discharge opening; and (c) a valve attached to the discharge conduit, the valve comprising a stationary frame and a pivoting plate, the pivoting plate having a horizontal position in which the hose is open and a vertical position in which the hose is closed.

I have also invented an improved method for delivering concrete to a construction site. The method comprises: (a) providing an amount of wet concrete; (b) pouring the amount of wet concrete into a concrete container comprising: (i) a barrel having an open top, a closed bottom, an interior adapted for holding an amount of concrete, and a discharge conduit near the closed bottom extending away from the barrel; (ii) a hose connected to the discharge conduit, the hose having a distal discharge opening; and (iii) a valve attached to the discharge conduit, the valve comprising a stationary frame and a pivoting plate, the pivoting plate having a horizontal position in which the hose is open and a vertical position in which the hose is closed; (c) transporting the concrete container to a construction site; and (d) opening the valve to allow wet concrete to flow from the interior of the barrel to the discharge opening of the hose.

The container of this invention is useful in providing an efficient and economical way of delivering medium amounts (about two to twenty cubic feet weighing about 800 to 8000 pounds) of concrete to construction sites.

DETAILED DESCRIPTION OF THE INVENTION

1. The Invention in General

Figure 1:
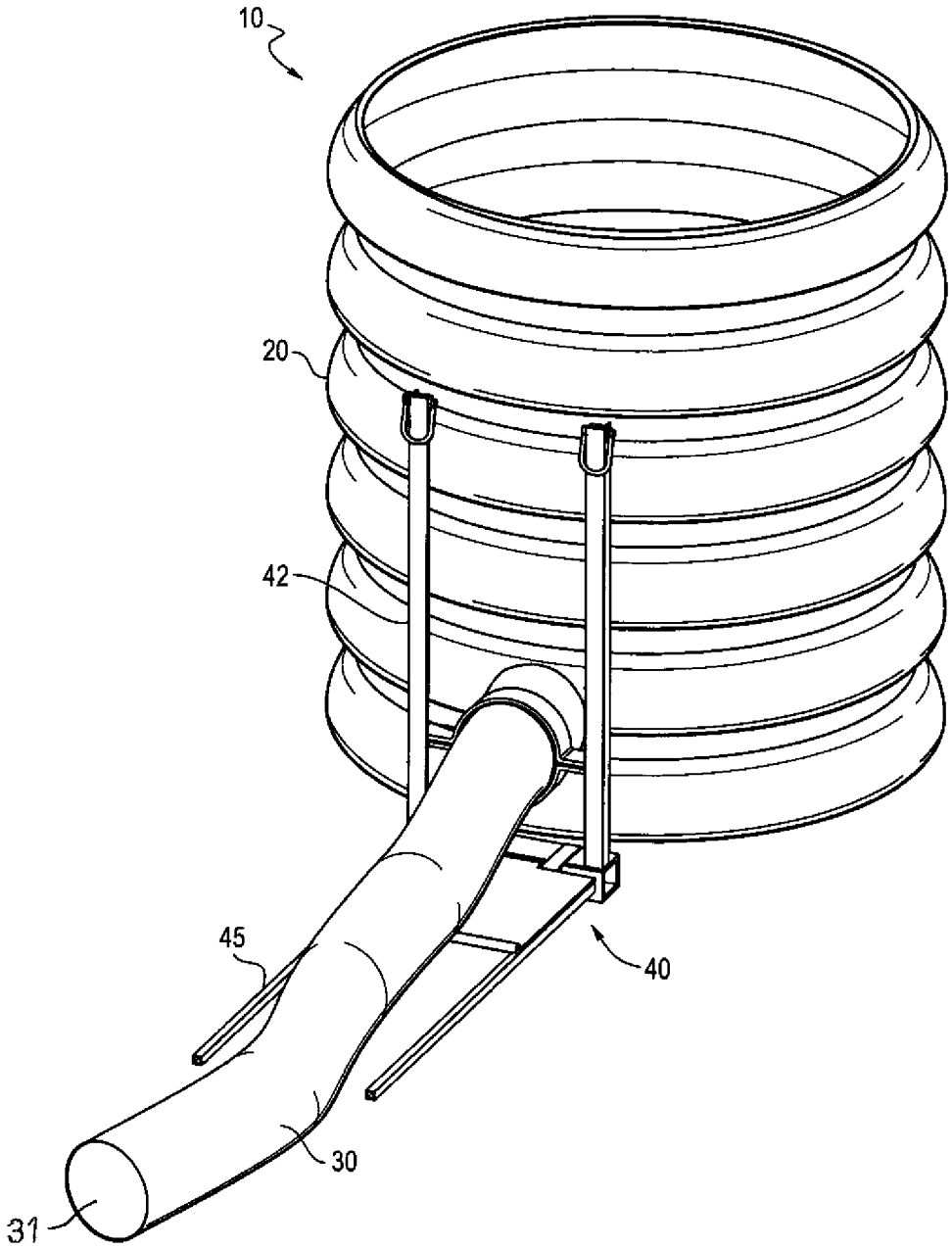
FIG. 1 is a perspective view of a preferred embodiment of the concrete container of this invention with the valve in the open position.

This invention is best understood by reference to the drawings. A preferred embodiment of the concrete container 10 of this invention comprises a barrel 20, a hose 30, and a valve 40. The three components of the concrete container are described in more detail below.

2. The Barrel

The barrel holds the concrete. The barrel is preferably cylindrical shape for maximum strength. The wall is made of a non-porous material. The wall 21 of the barrel is preferably made of a corrugated thermoplastic having a wall thickness of about one-fourth to one-half inch because of its light weight and structural strength. The preferred material is similar to the material used for drainage pipe. The interior of the wall is coated with a non-sticking material if desired.

The barrel has a sealed bottom 22 and an open top 23. The barrel preferably includes a lid 24. The lid prevents the concrete from spilling out the top during transport. The lid also reduces the speed at which the concrete in the barrel solidifies. The lid is preferably securely attached so it stays in place during transport. The barrel has a discharge conduit 25 in the wall near the bottom. The discharge conduit preferably has a diameter of about three to six inches.

Figure 3:
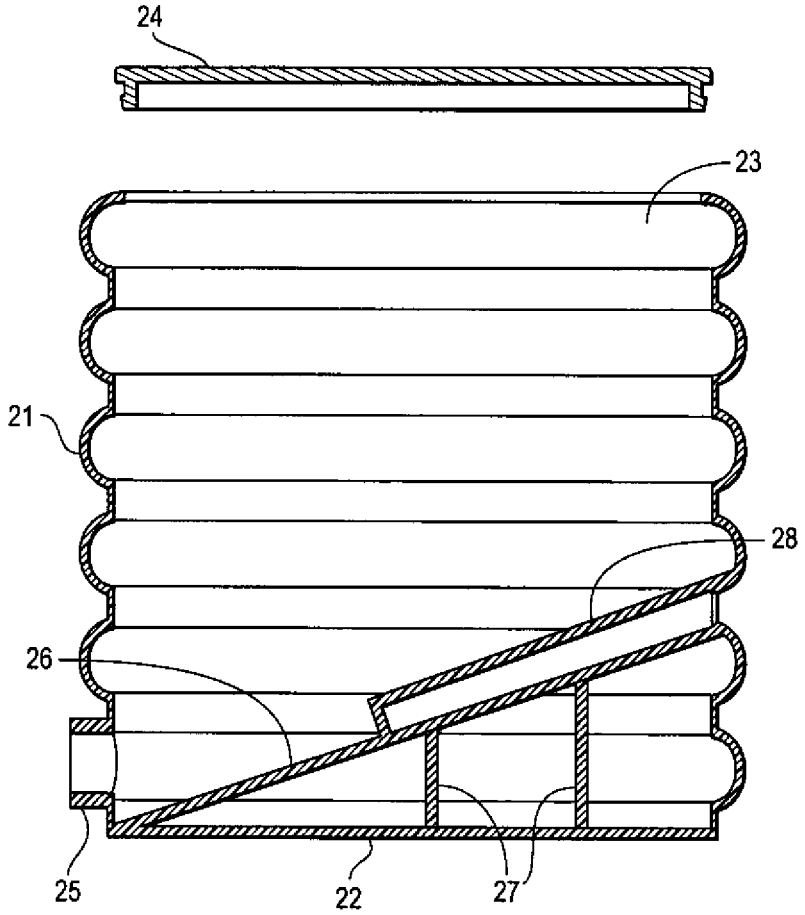
FIG. 3 is a sectional view of the barrel and lid of the concrete container.

The barrel preferably contains an internal fillet 26 that slopes toward the discharge conduit. The internal fillet increases the discharge flow rate and decreases the amount of residual concrete remaining in the barrel. The internal fillet is preferably an oval plate positioned along its perimeter to the inner wall of the barrel. The internal fillet is preferably reinforced with a truncated cylinder, two concentric truncated cylinders, a wall, or the like. In FIG. 3, a single truncated cylinder 27 is shown under the fillet. If the barrel includes an internal fillet, the sealed bottom can be omitted to save weight and material. The internal fillet shown in FIG. 3 is sealed along its perimeter to the interior wall of the barrel by plastic welding or the like. Alternatively, the internal fillet and the truncated cylinder(s) support form an assembly that is placed into the barrel and that is removed for flushing and cleaning. In this alternate embodiment, the perimeter of the internal fillet preferably includes an elastomeric gasket that provides a seal where the internal fillet meets the interior wall of the barrel.

If desired, the barrel contains an internal sleeve 28 that opens to the exterior and is sealed within the barrel. The sleeve accommodates a conventional concrete vibrating shaft. The vibrating shaft helps prevent the wet concrete from setting up within the barrel.

The size of the barrel is a matter of choice. A convenient barrel size has a diameter of about three feet and a height of about three feet. A container having a barrel of this size typically weighs less than 200 pounds and can be lifted easily by two men when empty. A container having a barrel of this size has a volume of about 20 cubic feet and can generally hold up to about 12 cubic feet of wet concrete. The barrel is not filled to the top to reduce spillage. The limiting factor for barrel size is generally the payload capacity of the truck to be used to transport the container. Conventional pickup trucks have payload capacities of about 1000 to 3000 pounds, which correspond to about 6 to 18 cubic feet of concrete in a 200 pound container.

3. The Hose

Figure 2:
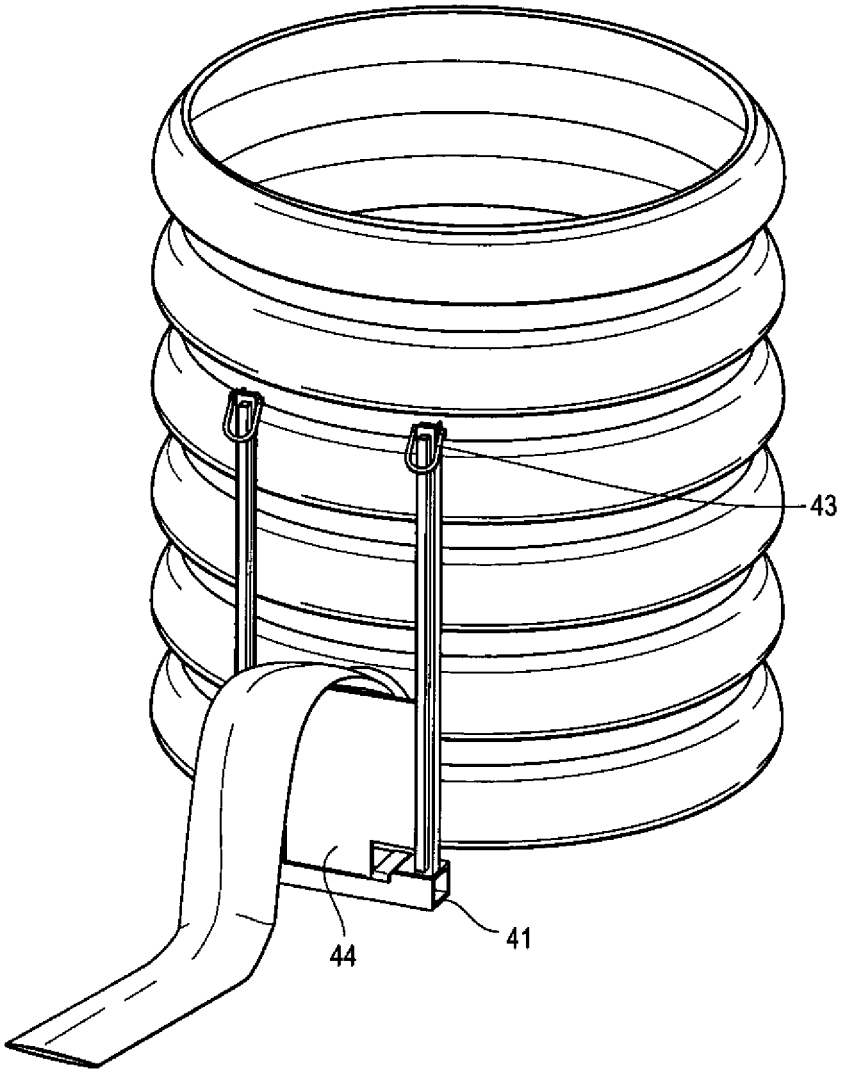
FIG. 2 is a perspective view thereof with the valve in the closed position.

The hose 30 is connected at its proximate end to the discharge conduit of the barrel. The connection is generally made with a circular hose clamp or the like. The hose has a distal discharge opening 31. The diameter of the hose is generally the same as the diameter of the discharge conduit of the barrel. The length of the hose is a matter of choice. The length of the hose is generally about five to ten feet so it can reach from the barrel to a wheelbarrow on the ground adjacent the pickup truck carrying the container or directly to the pour site. The hose is made of a durable flexible material that can be flattened as shown in FIG. 2. A preferred material is a synthetic rubber or a thermoplastic such as vinyl chloride. Alternatively, a portion of the hose downstream of the valve is replaced by an open-topped semi-rigid chute that connects to or otherwise communicates with the hose portion of the valve. An open-topped chute is easier to flush than a closed hose after use.

4. The Valve

The valve 40 controls the flow of concrete out of the barrel and through the hose. In its open position shown in FIG. 1, the valve allows flow. In its closed position shown in FIG. 2, the valve prevents flow. A variety of valves are known, but many are unsuitable because of the physical nature of wet concrete. Gate valves having an internal or external movable plate to block the flow are suitable, but even they are prone to failure because of concrete drying and preventing movement of the gate.

The preferred valve is the one shown in FIGS. 1 and 2. This valve has a base 41 and two spaced apart uprights 42. Swiveling latches 43 are located at the tops of the uprights. A pivoting plate 44 is connected to the base. The pivoting plate has two spaced apart uprights 45 that align with and contact the uprights of the base. The two pairs of uprights are held together with the swiveling latches.

When the pivoting plate is in the horizontal position as shown in FIG. 1, the hose is unobstructed and assumes its round shape. When the pivoting plate is raised and latched in place as shown in FIG. 2, the pivoting plate flattens the hose and prevents flow. It can be appreciated that there is no contact between this valve and the wet concrete.

5. Use

The concrete container is used to transport medium amounts of wet concrete from a preparation site (typically a concrete plant) to a construction site. The concrete container is generally placed onto the bed of a pickup truck. The valve is closed and the barrel is filled with the desired amount of wet concrete. The lid is then placed onto the barrel. The truck is then driven to the construction site and parked where the concrete is to be poured. If the truck is unable to reach the pour site, a wheelbarrow or the like is placed at the back of the truck for final transportation of the concrete to the pour site. The valve is then opened and the hose is extended. The wet concrete then flows out of the barrel and through the hose and through the chute (if one is used).

Any excess wet concrete is disposed of in a conventional manner. The interior of the barrel and hose are then thoroughly flushed with water. If the internal fillet and support form a separate assembly, it is removed from the barrel and flushed separately before reassembly. The concrete container is then returned to the preparation site for reuse.

As previously mentioned, the concrete container is especially suited for delivering medium amounts (about two to twenty cubic feet weighing about 300 to 3000 pounds) of concrete to a construction site.

I claim:

1. A concrete container comprising:

(a) a barrel having an open top, a closed bottom, an interior adapted for holding an amount of concrete, and a discharge conduit near the closed bottom extending away from the barrel;

(b) a hose connected to the discharge conduit, the hose having a distal discharge opening, the hose being flexible and being capable of being flattened; and (c) a valve attached to the discharge conduit, the valve comprising: (i) a stationary frame having a base and two spaced apart uprights, and (ii) a pivoting plate having two spaced apart uprights, the pivoting plate having a horizontal position and a vertical position, the valve having an open position in which the hose is open when the pivoting plate is in the horizontal position and having a closed position in which a portion of the hose is flattened and closed when the pivoting plate is in the vertical position.

2. The concrete container of claim 1 wherein the two spaced apart uprights of the stationary frame and the two spaced apart uprights of the pivoting plate are aligned and latched together when the hose is closed.

3. The concrete container of claim 2 wherein the interior of the barrel comprises an inclined fillet having a lower point adjacent the discharge conduit.

4. A method for delivering an amount of the wet concrete comprising:

(a) providing an amount of wet concrete;

(b) pouring the amount of wet concrete into a concrete container comprising: (i) a barrel having an open top, a closed bottom, an interior adapted for holding an amount of concrete, and a discharge conduit near the closed bottom extending away from the barrel; (ii) a hose connected to the discharge conduit, the hose having a distal discharge opening, the hose being flexible and being capable of being flattened; and (iii) a valve attached to the discharge conduit, the valve comprising: (1) a stationary frame having a base and two spaced apart uprights, and (2) a pivoting plate having two spaced apart uprights, the pivoting plate having a horizontal position and a vertical position, the valve having an open position in which the hose is open when the pivoting plate is in the horizontal position and having a closed position in which a portion of the hose is flattened and closed when the pivoting plate is in the vertical position;

(c) transporting the concrete container to a construction site; and (d) opening the valve to allow wet concrete to flow from the interior of the barrel to the discharge opening of the hose.

5. The method of claim 4 wherein the two spaced apart uprights of the stationary frame and the two spaced apart uprights of the pivoting plate are aligned and latched together when the hose is closed.

6. The method of claim 5 wherein the interior of the barrel comprises an inclined fillet having a lower point adjacent the discharge conduit.

* * * * *